United States Patent [19]

Mader

[11] Patent Number: 4,742,793

[45] Date of Patent: May 10, 1988

[54] LIFT-PRODUCING BOAT HULL ESPECIALLY FOR SAILBOATS

[76] Inventor: Paul Mader, Klaussnerplatz 20, 1000 Berlin 19, Fed. Rep. of Germany

[21] Appl. No.: 880,115

[22] Filed: Jun. 30, 1986

Related U.S. Application Data

[63] Continuation of Ser. No. 647,267, Sep. 4, 1984, abandoned, which is a continuation of Ser. No. 355,600, Feb. 17, 1982, abandoned.

[30] Foreign Application Priority Data

Jun. 19, 1980 [DE] Fed. Rep. of Germany ..... 3022966

[51] Int. Cl.[4] ..... B63B 1/20

[52] U.S. Cl. ..... 114/271; 114/56

[58] Field of Search ..... 114/56, 271, 355–358

[56] References Cited

U.S. PATENT DOCUMENTS

| | | | |
|---|---|---|---|
| 1,581,881 | 4/1926 | Smith | 114/271 |
| 2,515,161 | 7/1950 | Hall | 114/356 |
| 3,298,343 | 1/1967 | Juhnke | 114/56 |
| 3,930,455 | 1/1976 | Bremer | 114/56 |

FOREIGN PATENT DOCUMENTS

| | | | |
|---|---|---|---|
| 490352 | 1/1930 | Fed. Rep. of Germany | 114/271 |
| 485572 | 6/1938 | United Kingdom . | |
| 997739 | 7/1965 | United Kingdom . | |

*Primary Examiner*—Joseph F. Peters, Jr.

*Assistant Examiner*—Clifford T. Bartz

*Attorney, Agent, or Firm*—Frishauf, Holtz, Goodman & Woodward

[57] ABSTRACT

The body of the ship, particularly sailing yachts and boats, on which is exerted, as a result of the displacement-originated forces, a lifting force such that the body starts to plane, has, at least in one longitudinal region located underneath the horizontal plane (12) defined by the water surface, a vertical longitudinal profile (14) of which the lower portion has a shape corresponding to that of the lower portion of the profile of an aerofoil. The longitudinal profile extends towards the stern (10) substantially tangentially to the horizontal plane (12). The chord (S) of at least this aerofoil lies within the horizontal plane. The lower portion of the body may have the shape indicated in lateral longitudinal regions and may have in a central region profile chords having a positive or negative incidence angle. Conversely, the shape indicated may be realized in the central region, the profile chords having a positive or negative incidence angle being located in the lateral regions. The highest point (18) of the lower actuated portion of the body, respectively the profile, is located between 30% and 50% of the length of the profile chord, that is to say the distance apart between the culminating point (18) and the front end of the chord (20), respectively the chords, is less than 50% of the total length of the chord and preferably comprised between 30 and 50%.

9 Claims, 9 Drawing Sheets

LIFT-PRODUCING BOAT HULL ESPECIALLY FOR SAILBOATS

This application is a continuation of application Ser. No. 647,267, filed Sept. 4, 1984, abandoned, which was a continuation of application Ser. No. 355,600 filed on Feb. 17, 1982, abandoned and based on the filing of PCT application DE 81/0091 filed June 16, 1981.

The invention concerns a hull generally of the kind in which the underside has the profile of an aircraft wing, at least in one longitudinal section thereof, in which the center of gravity of the boat, usually a sailboat, is positioned in such a way that the stern, particularly a stern transom, does not extend appreciably below the waterline plane, at least when the boat is unloaded, and in which the chord of the aircraft wing profile lies substantially in the waterline plane.

In known hulls of this type the underside of the boat extends downward from the bow to a lowest point under the boat, from where it again rises toward the stern of the boat, forming an angle with the horizontal plane at the end of the stern. In such a conventional profiling of the hull, the boat moves with a displacement effect, so that when it moves, even at higher speeds, lift does not occur.

To produce a lift effect, it is necessary as the speed increases to load down the hull increasingly at the stern in such a way that the profile of the hull rises in relation to the water surface. Such a rise of the hull produces increase of the resistance against which the boat moves; within the range of planing speed the boat is also relatively unstable and very difficult to manoeuver.

From the foregoing it is the object of the invention to design the hull in such a way that the actual planing process begins very early; while moving—even at slow speed—the forces acting on the underside of the boat are to lift the hull and thus to produce planing without requiring the necessity of the entire hull rising at an angle.

SUMMARY OF THE INVENTION

Briefly, in at least one longitudinal zone of the bottom of the boat hull below the waterline plane, the vertical longitudinal section profile of the aircraft wing type extends aft substantially tangentially to the waterline plane. With the chord of that profile, lying substantially in the waterline plane, the downward vertex of the profile is located relative to the forward end of that chord within a range of less than 40% of the entire chord length. Furthermore, the front edge of the profile, over the width of the longitudinal zone having the aircraft wing profile, is swept back substantially across the width of this zone on both sides of the vertical longitudinal midplane of the hull, and this front edge sweepback is continued across the width of the boat to define the front edge of lateral zones running longitudinally of the hull which are profiled in aircraft wing profile in a manner similar to the middle longitudinal zone lying between these lateral zones, but with the plane of the aircraft wing profiles in the lateral zones being inclined to the vertical plane of the corresponding profile in the middle longitudinal zone.

Preferably, and most significantly, aft of where the aircraft wing profile becomes tangential to the waterline plane there is a region of the profile running along the waterline plane (when the boat is level) which measures 5 to 25% of the total length of the hull. Since the chord of the profile, at least in the zone in question lies in the waterline plane, this aft portion of the profile substantially coincides with the chord. Various additional features are advantageously combined with the features above mentioned and are set forth in a detailed description given below. In particular, the longitudinal section of the hull above referred to may be flanked by sections of similar profile of which the vertices rise laterally or extend laterally level or downwards to a rising portion and in such case, it is desirable for the plane containing the chord and the aircraft wing profile to be inclined to the vertical planes in which the corresponding profiles of the midsection lie.

Designing the hull in the form of the underside of a wing profile offers the advantage that at low speeds the so-called planing can be achieved. In this, the direction of flow of the water in relation to the hull in the area of the stern is parallel to the underside of the boat, i.e. the included angle at this point is practically zero, which means that the resistance is reduced accordingly.

BRIEF DESCRIPTION OF THE DRAWINGS

The invention is explained below by means of embodiments with reference to the accompanying drawings.

FIG. 18 is a diagram similar to FIGS. 9 and 11 illustrating a converse case in which the underbody aircraft wing profiles have chords inclined to the waterline plane in a central zone and have chords lying in the waterline plane in zones spaced apart and located on opposite sides of the longitudinal vertical midplane of the hull.

FIG. 1 shows an asymmetric profile of an aircraft wing, i.e. a profile whose Y values above chord S are different than those below chord S. Thus, chord S is the straight line that connects the forward end of the profile with its aft end.

FIG. 2 is a side view of the hull of a sailing boat or yacht. The underside of this hull according to the invention is so formed that in motion lift-producing forces are generated without the boat having to rise. The center of gravity is so situated that the stern 10 of the non-loaded boat does not reach below the horizontal plane 12 of the water level. In at least one of the longitudinal zones lying below the horizontal plane 12, the underside of the hull has the same longitudinal section profile 14 as the underside of the aircraft wing shown in FIG. 1. In area 16 this profile extends tangentially to the horizontal plane 12 of the water level (waterline plane) while chord S of the wing profile lies in the horizontal plane 12 of the water level. The included angle of the boat underside in area 16 is therefore zero or virtually zero. This results in very low drag at all speeds, since the boat largely retains the prescribed relative position at all speeds. The hull shown in FIG. 2 begins planing at very low speeds. When that is the case, the hull over its entire length is largely within the area of the half-wavelength of the generated bow wave, whereby the water in area 16 flows largely parallel to the boat underside. Vertex 18 of the arcuate underside of the hull, i.e. the point at which dimension "Y" has the highest value lies closer to the bow than to the stern. In particular the distance between vertex 18 and the forward end (20) of chord S can be less than 40% of the entire chord length. This results in a particularly favorable flow in the range of cruising speeds up to 40 knots.

Figure 2:
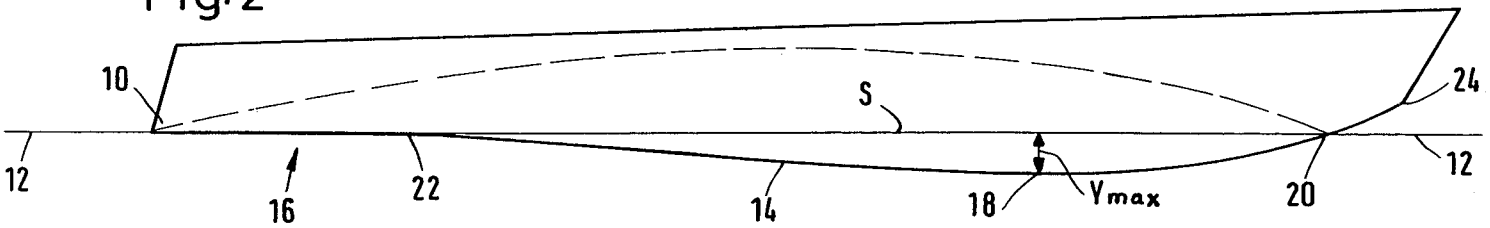
FIGS. 2 and 3 are side view of hulls according to the invention, particularly for sailing daysailers and other light sailboats.

In the embodiment shown in FIG. 2 Y becomes zero approximately at point 22. Here the longitudinal section profile (14) also meets chord S tangentially. Between points 10 and 22 the underside of the boat runs parallel to horizontal plane 12. Thus, the distance between points 10 and 22 can be 5% to 25% of the length of chord S which extends from stern 10 to the forward end 20 of longitudinal section profile 14. It is also possible to let stern 10 coincide with point 22. The shape shown in FIG. 2 where stern 10 is at a considerable distance behind point (22), offers particular advantages for higher speed ranges of more than 15 to 20 knots. These advantages consist in that chord S retains its position parallel to horizontal plane 12 and requires no greater included angle which would lead to greater resistance. Toward the bow the vertical longitudinal zone profile of the underside of the hull is continued above horizontal plane 12 of the water with unchanged or little-changed curvature up to a point 24. The further course depends on the shape of the bow, for which various shapes are shown by the broken lines in FIG. 3.

Figure 1:
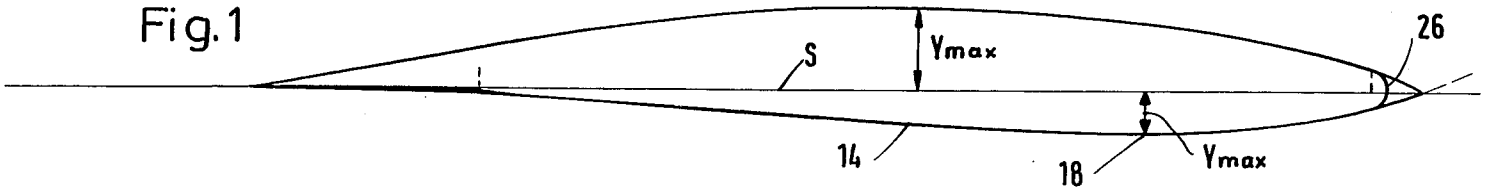
FIG. 1 is an aircraft wing profile, whose design below the chord corresponds to that of the hull according to the invention—at least in one longitudinal zone.

The broken line of FIG. 1 shows where the vertical longitudinal section profile 14 of the underside is continued forward with unchanged or little-changed curvature. This results in a wing profile without leading edge radius. The hull underbody profile in this case extends tangentially forward from the rounded-leading edge wing profile to intersect the chord and the horizontal water level plane at a point forward of the rounded wing profile leading edge. However a profile rounded at the front with leading edge radius can be used as FIG. 1 also shows at 26.

Figure 3:
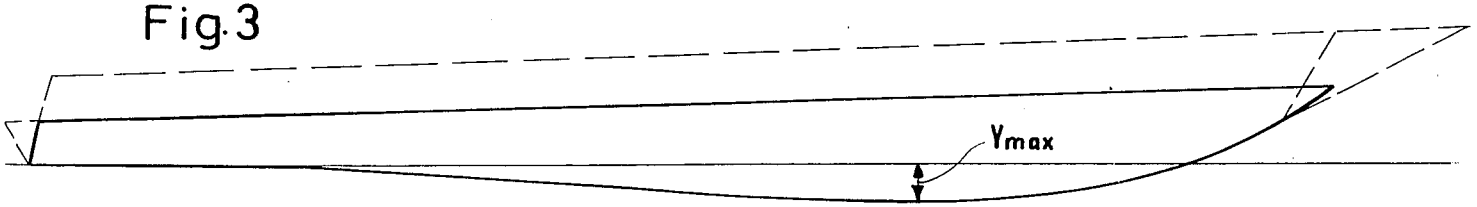
Figure 4:
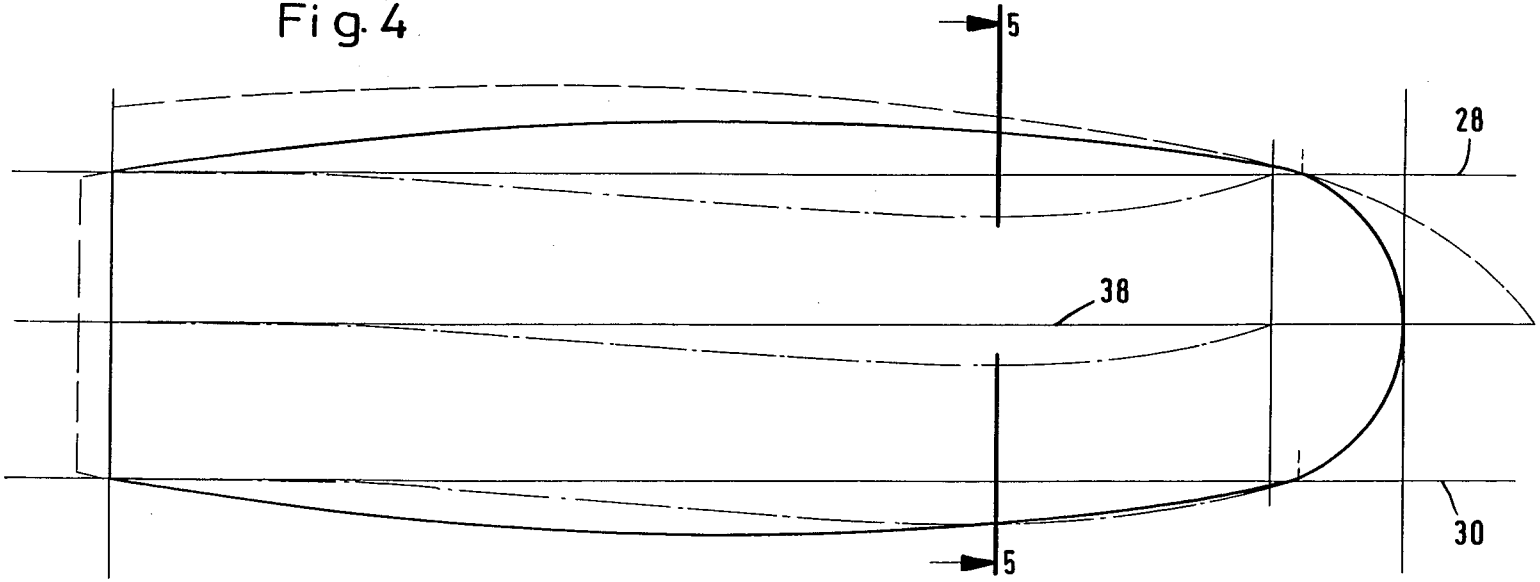
FIG. 4 shows the plan view according to the construction in FIG. 3.
Figure 5:
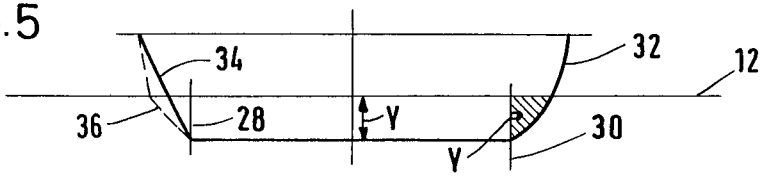
FIG. 5 is a sectional view taken on lines 5—5 in FIG. 4.

FIGS. 3 and 4 show an embodiment in which the hull has a scow-like body shape. In this embodiment all longitudinal section profiles of the boat underside between the parallel vertical planes 28 and 30 coincide, These longitudinal section profiles also have the same chord length and the same Y values. If the hull were bordered laterally by planes 28 and 30 the sidewall would abruptly and rectangularly rise from the water surface. In order to avoid this, the hull has been widened laterally beyond planes 28 and 30 and designed there as shown in FIG. 5 in three different forms of a vertical transverse section of the hull. Thus FIG. 5 (right) shows a hull in which the sidewall has rounded ribs (32). FIG. 5 (left) shows a sidewall with simple diagonal ribs 34 or angled ribs 36.

Figure 6:
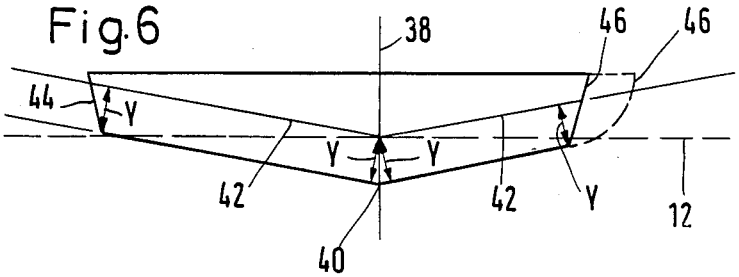
FIG. 6 shows vertical transverse sections of hulls where the design of the left side differs from that of the right side.

This shape shown in FIG. 4 of the underside of the hull lying under the water level is however not the best suited for all boat shapes, since the boats move more or less about a horizontal central axis. Because of this movement the profile surface which generates lift and is in contact with the water is more or less symmetrically or assymmetrically changed. What must be taken into account is the influence of the sidewall which no longer belongs to the longitudinal zone of the underside of the hull. In order to obtain more accurate wing arrangements which are more accurately defined in terms of the midship plane, in which the profile chord plane intersects the water line at a predetermined angle, the embodiment shown in FIG. 6 is recommended. The left half of this figure shows a vertical section through a hull in which the longitudinal zone of the underside of the hull in which the longitudinal vertical planes of the portion of the hull below the waterline have essentially the profile of the underside of an aircraft wing, of which the chord lies in the waterline plane, is limited to a narrow zone 40, which includes the vertical longitudinal central plane (38). Thus it only applies to this zone 40 that the chord of the wing profile lies in horizontal plane 12. The longitudinal section profiles of the hull underside which extend at a greater distance from the longitudinal center plane 38 have the same shape as the longitudinal section profile in zone 40, but different height levels. Their chords lie in outlines 42, which rise toward the hull sides 44. In the embodiments shown in the right and left portions of FIG. 6, the outlines 42 are planes. The hull sides 44 can have straight ribs as shown in FIG. 6 (left), or curved ribs 46 as shown in FIG. 6 (right). In these embodiments, too, the vertices of the longitudinal section profiles of the boat underside lie in a common plane of the hull, as in FIG. 4 which shows this common transverse plane 5—5.

There is also correspondence with the embodiment shown in FIG. 4 insofar as the vertical longitudinal section profile of the hull underside is of corresponding design in all vertical longitudinal planes.

Figure 7:
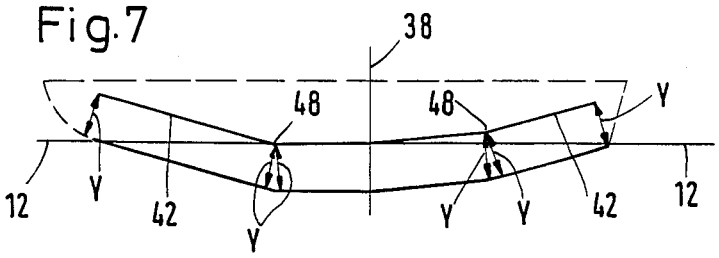
FIG. 7 shows left- and right-sided sectional views of other hulls according to the invention.

FIG. 7 shows two embodiments in which outlines 42 are not level but angled. In this the angled lines 48 consist of straight lines which run parallel to the vertical longitudinal middle plane of the hull.

Figure 8:
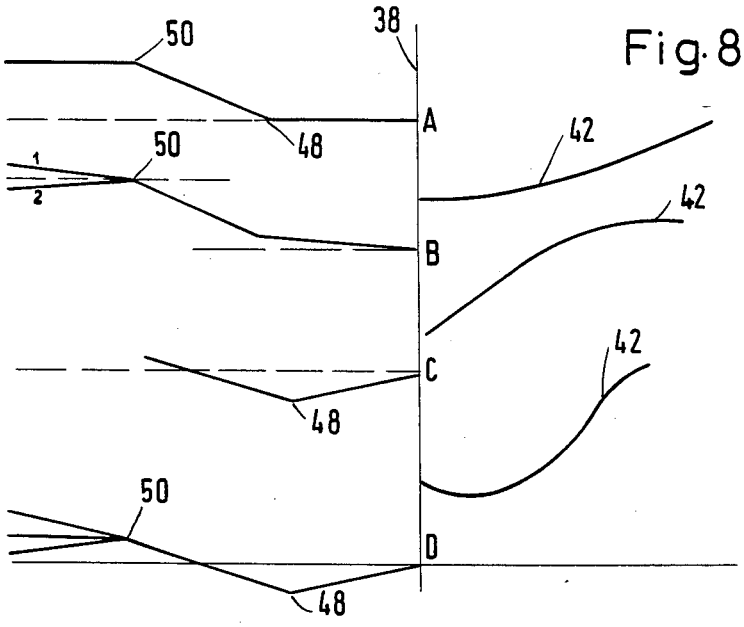
FIG. 8 shows characteristic lines for seven different hulls according to the invention.

FIG. 8 shows other complexly curved, multi-angled wing arrangements. The characteristic lines shown there represent outlines 42 in which lie the chords S of the vertical longitudinal section profile of the hull underside. Line A is angled twice, namely at 48 and 50. Line B is also twice-angled and extends from the vertical longitudinal center plane 38, first slightly and then increasingly upwards, and outside the angled line 50, either upwards or downwards. Line C shows an outline 42 which from the vertical longitudinal plane 38 first extends slightly downward and then, outside angled line 48, upward. Line D resembles line C but has a second angled line 50 and can assume three different directions beyond that angled line.

The right side of FIG. 8 shows embodiments in which outlines 42, containing chords S of the wing profiles of the boat underside, are curved. These curved outlines 42 have straight generatrices, which run parallel to vertical longitudinal central plane 38 of the hull.

For the sake of simplicity, these curved outlines 42 are shown without reference to the horizontal plane 12 of the water level. The relative position of the water level to the hull is solely dependent on the volume, the listing angle, the stability, the desired wetted surface, and the desired planing angle. However, in principle, these factors do not change the design.

Figure 9:
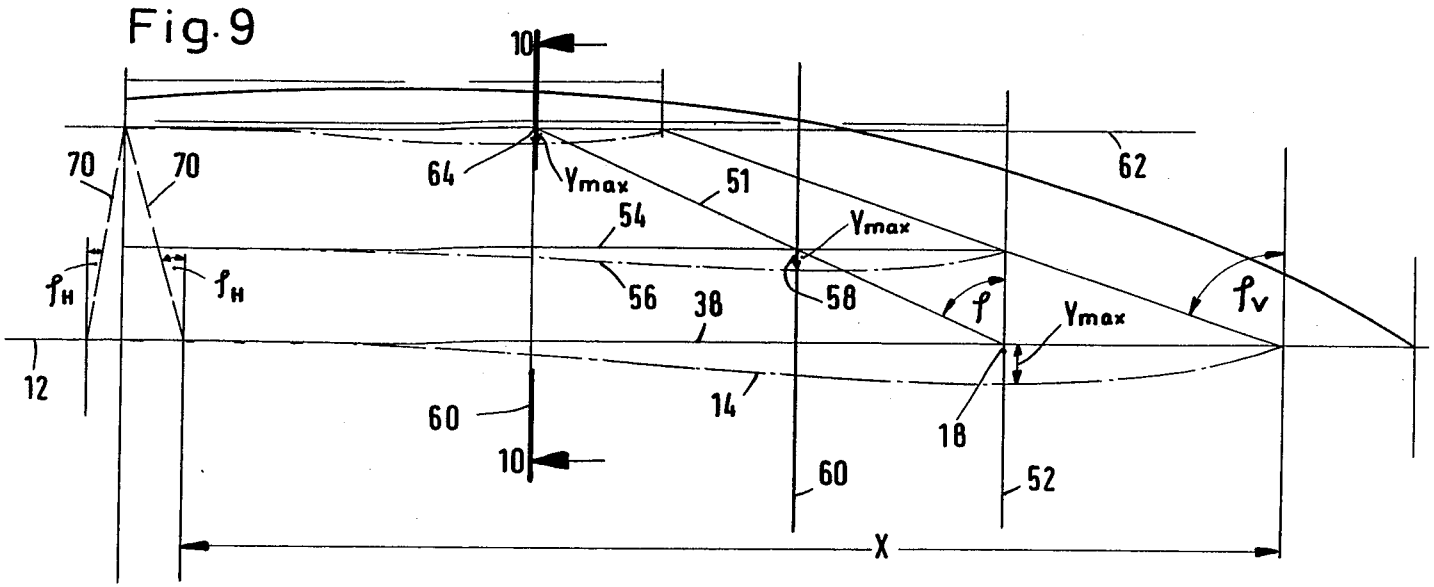
FIG. 9 shows a bottom view of one half of the hull illustrated in FIG. 2, where the relative allocation of the characteristic lines is shown.
Figure 11:
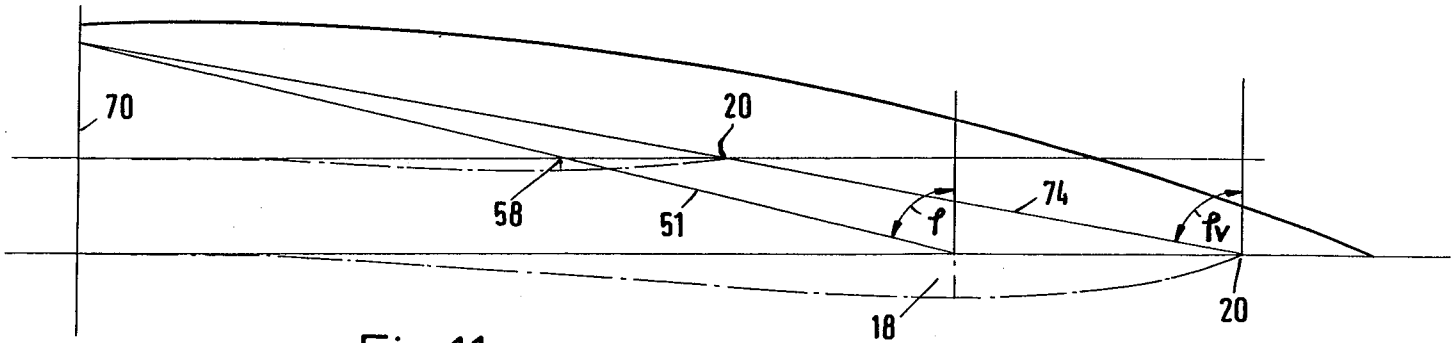
FIG. 11 shows another hull according to the invention which corresponds to FIG. 9.

In analogy to the design of aircraft wings, there is the further possibility of sweeping the carrying surfaces of the hull underside backwards to each side of center instead of upwards, as shown in FIGS. 6 and 7. FIGS. 9 and 11 explain this.

FIG. 9 shows the underside of the hull illustrated in FIG. 2. The vertical longitudinal center plane 38 is shown in FIG. 9 as a straight line under which the longitudinal section profile 14 is drawn with dots and dashes. Here the vertex 18 lies in the vertical transverse plane 52.

In longitudinal plane 54 which runs parallel to plane 38, the hull underside lying under the water level has longitudinal section profile 56 which has not only a considerably shorter chord S than longitudinal section profile 14, but at vertex 58 has also a considerably smaller maximum value of Y which lies in transverse plane 60, which lies closer to the stern than transverse plane 52. In the vertical longitudinal plane 62 which extends parallel to longitudinal planes 54 and 38 the hull underside lying below the water level has an even shorter wing profile with vertex 16 at which $Y_{max}$ occurs, which is even smaller than that at vertex 58. Vertex 64 lies in a transverse plane 66 which lies even closer to the stern than transverse plane 60.

The three vertices 18, 68 and 64 lie in a vertical plane 51 which, with transverse plane 52, includes angle $\phi$.

Above the horizontal plane of the water level the hull at the stern has a transom 70 which may slant toward horizontal plane 12 (FIG. 2). It may also slant toward the vertical longitudinal center plane 38 as indicated by the two angles $\phi_H$ in FIG. 9, shown respectively for two different possible cases.

An important value for the sweepback of the profile is also the angle $\phi$ which is enclosed by outlines 51 and 52.

While in the embodiment of FIG. 9 outline 51 is a plane, it is also possible to angle it. This means that the three vertices 18, 58, and 64 have a curved connecting line. When the profiles in the three longitudinal planes 38, 54 and 62 have the same ratio of length to thickness and if the length of their chords S decreases as the distance from center plane 38 increases, the absolute values of X and Y decrease toward the side of the boat. Even when chords S lie in the same horizontal plane, this means that the boat bottom rises outwardly. This effect can be heightened by arranging chords S in planes 42 of FIGS. 6–8 instead of at the same height levels.

As already mentioned, the transom 70 can have various designs. Angle $\phi_H$ can be positive, negative or zero.

Figure 10:
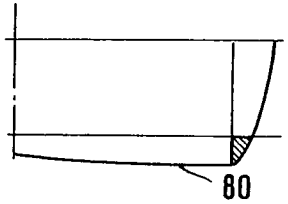
FIG. 10 is a sectional view taken on line 10—10 of FIG. 9.

If plane 51 curves, so that profile length X decreases irregularly toward the outside, the boat bottom also has a curved outline in vertical direction, viewed from the horizontal plane. When the angles are smaller, the boat bottom curves complexly, since, depending on the selected profiles the size of Y in the direction of the side area can increase, as line 80 in FIG. 10 shows. To avoid this, a weaker sweepback or delta-wing construction is advisable. Complex curving can also be produced by complexly curving profile plane 42 as viewed from the side. These possibilities are mainly of interest for surface skimmers and multi-hull boats.

Figure 12:
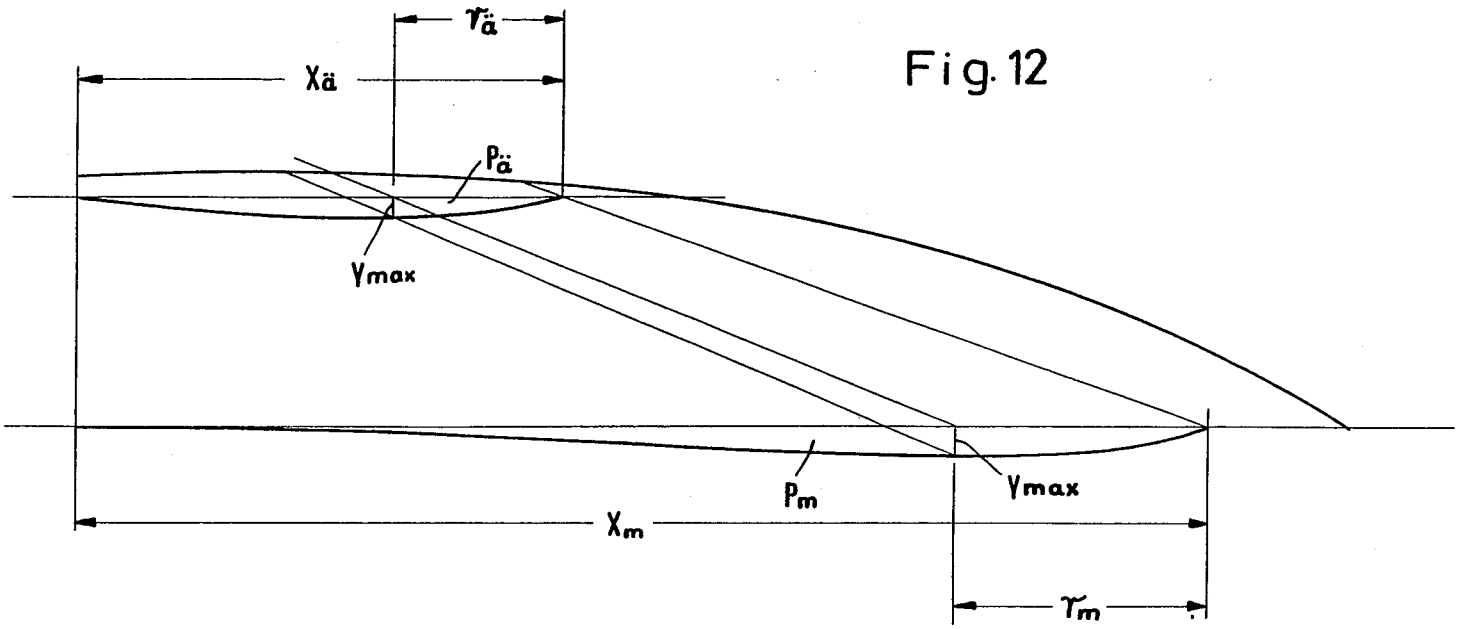
FIG. 12 is a diagram of a hull comparable to that shown in FIG. 9 with the exception that the airplane wing chord underbody profiles and outer portions of the hull have chords at a small acute angle to the horizontal plane.
Figure 13:
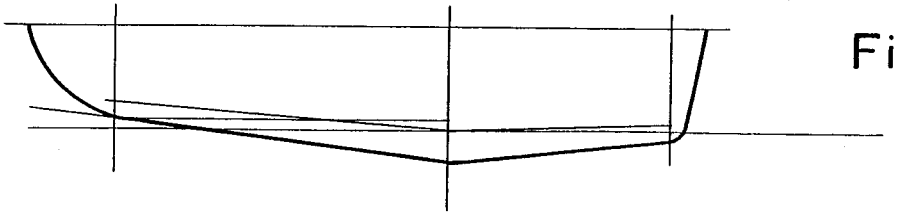
FIG. 13 is a diagram of athwatship sections of a hull, the half section at the right being a section forward of a midship and half section at the left being a section in the after portion of the hull, in accordance with the usual convention regarding ship plans, the half sections joining at the longitudinal vertical midplane.

In the embodiments shown in FIGS. 3–5 not only chord S of the wing profile in the vertical longitudinal center plane 38 but also the chords of the wing profiles in the planes running parallel to that plane, for example in planes 28 and 30 all lie in the horizontal plane 12 of the water level 12. In deviation from this form of hull a complex curving of the profile chord plane 42 results when the underside of the hull has having profiles in vertical longitudinal planes which correspond essentially to the profile of an airplane wing below the chord thereof only in lateral longitudinal zones, a shape in which the chord of the bottom profile lies in the horizontal plane of the water level, while between these lateral longitudinal zones in a middle zone the chords have a positive or negative included angle, i.e. that they do not lie in the horizontal plane of the water level. The following gradual transitions are possible:

1. The profile chords lie in a middle zone in the horizontal plane of the water level, but further outwardly they form a positive or negative angle with the horizontal plane (FIG. 12).

2. In a middle zone the profile chords have a positive or negative angle with respect to the horizontal plane, and further outwardly the chords extend in the horizontal plane of the water level or parallel thereto. This is illustrated in FIG. 18.

Furthermore there is the possibility of making all profile chords more or less positively or negatively incident to the plane of the water line.

In the hull shape shown in FIG. 11 the chord lengths of the wing profiles of the hull underside decrease to zero from inside to outside. The forward ends of the wing profiles lie in a vertical plane 74 which intersects plane 51 at the transom 70. The more outwardly the vertical longitudinal profile lies in relation to the hull underside, the smaller is the distance between the forward end 20 of this profile and vertex 18 or 54.

FIGS. 12–18 show various embodiments of hulls according to the invention. These embodiments illustrate how the design principle can be accomplished within the scope of the concept inherent in the invention.

For example, FIG. 12 shows a construction which is comparable to that shown in FIG. 9 with the exception that the outer profile $P_{\ddot{a}}$ with an angle of more than 4° toward the horizontal plane of the water at the stern. The profile $P_{\ddot{a}}$ according to FIG. 12 is characterized in that the outer profile in relation to its chord length $X_a$ has a greater value $Y_{max}$ than the middle profile, $P_m$, again related to chord length $X_m$. Furthermore the outer profile has a greater incline than the inner profile, i.e. relatively a greater incline $r_a$ than the middle profile. The incline is the measurement from the tip to the intersection of value $Y_{max}$. Because of this design possibility, adaptations can be made for various requirements: thus within the scope of the inventive profiling and construction principle any desired displacement and ship configuration can be achieved (e.g. narrow stern, wide stern etc.).

Figure 14:
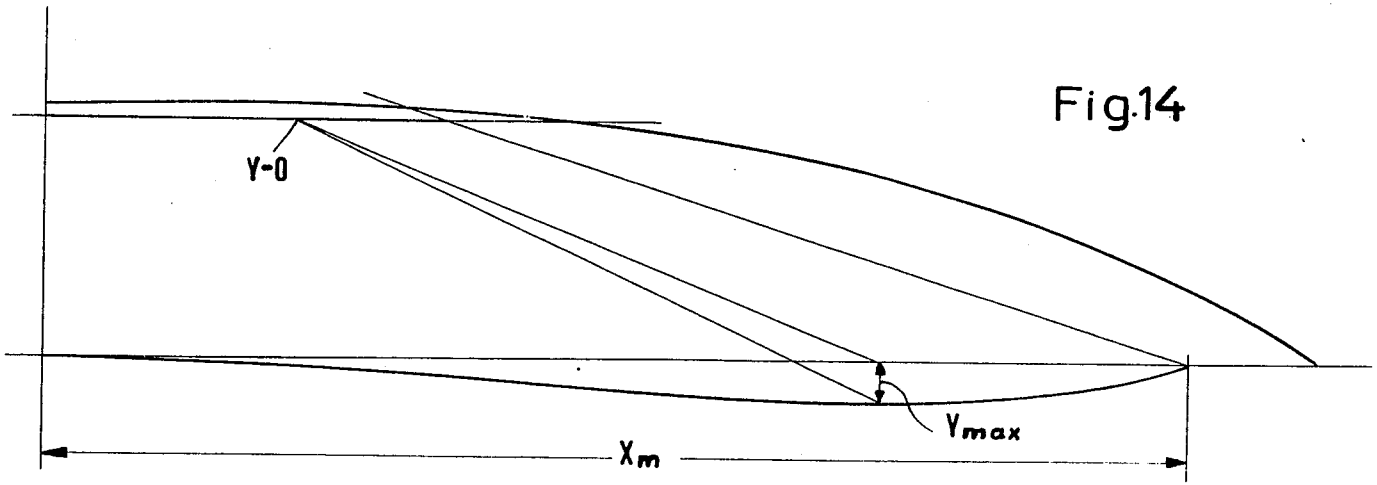
FIG. 14 is a diagram of the hull of FIG. 13 in the same aspect as FIG. 12, but in this case showing an extreme possibility where the vertex distance between the chord and the aircraft wing profile diminishes essentially to zero at the extreme width of the underbody of the hull.

The embodiment of FIG. 14 constitutes an extreme constructive possibility, since at this value the outer profile in terms of the Y value is zero or virtually zero.

Figure 15:
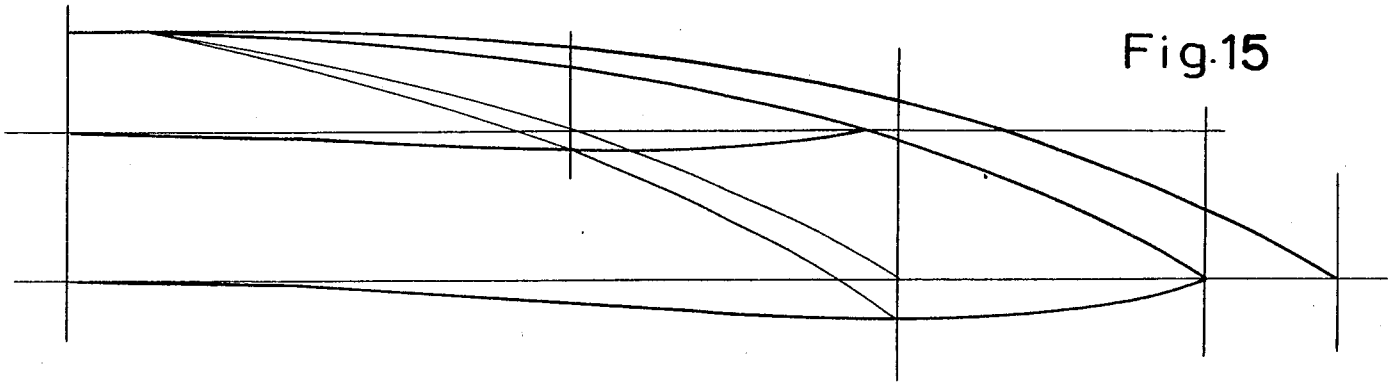
FIG. 15 is a diagram of a hull in the same aspect as FIG. 12 showing a profile design in which there is a curved sweep-back of the line of apices which is convex.
Figure 16:
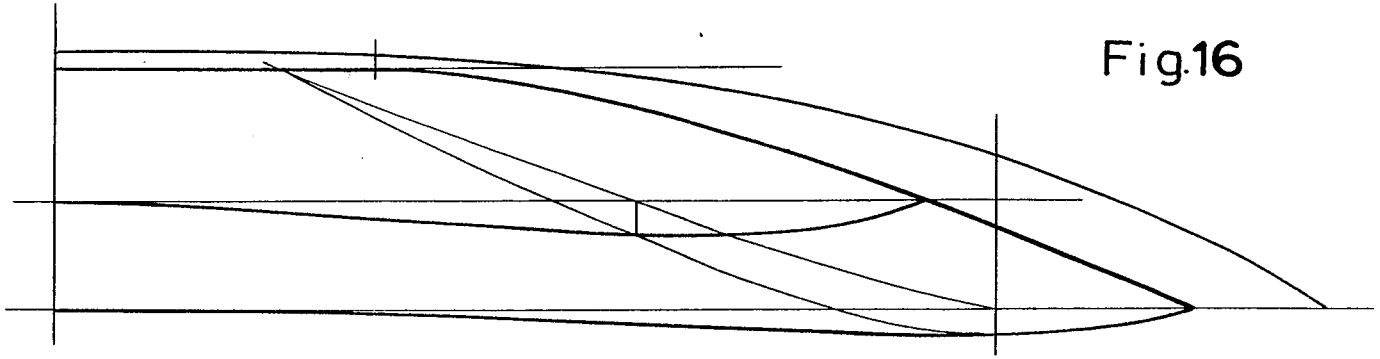
FIG. 16 is a diagram similar to FIG. 15 showing a hull shape in which there is a concavely curved sweep-back of the line of apices.
Figure 17:
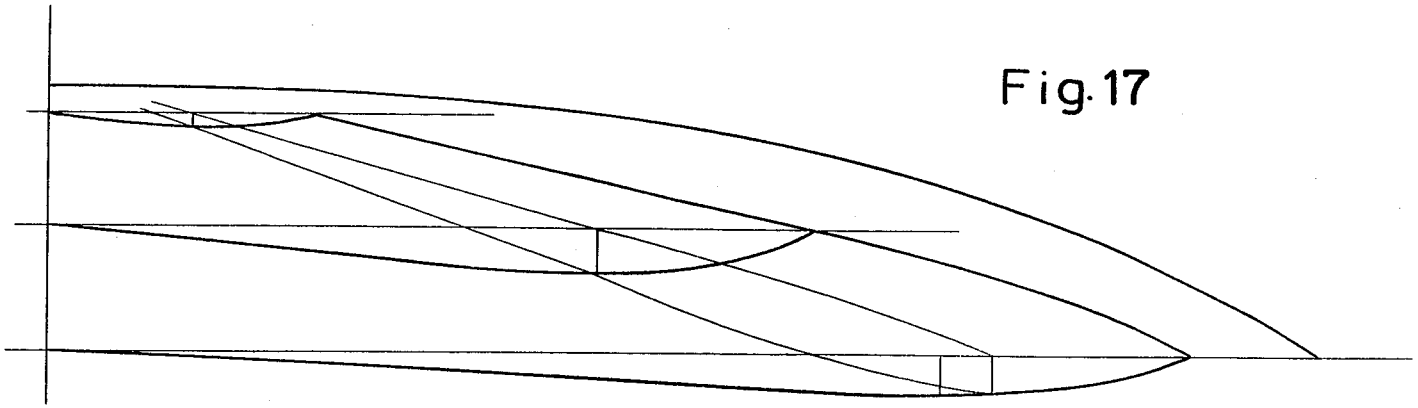
FIG. 17 is a diagram similar to FIGS. 14–16 shown a hull shape in which the vertex distance from the chord does not diminish to zero at the extreme width of the underbody of the hull.

FIG. 15 demonstrates a profile design in which there is a curve form with forward profile limitation, i.e. with the intersection of each forward chord value with the horizontal plane. This curve form exists in combination with a curved continuously increasing incline (value r) which corresponds to a continuous enlargement of angle $\phi$. The value $Y_{max}$ at the same time decreases continuously toward the outside. As a variation there is a possibility that the so-called inclination r remains constant or that the incline decreases while the value $Y_{max}$ is discontinuous. The other figures demonstrate the design variations possible within the scope of the invention, whereby the profile connecting lines may assume the configurations shown. Here too, based on the factors such as displacement, weight, speed, etc., those profile points can be determined at which the desired planing ability of the boat is possible without requiring the boat underside to rise.

As already mentioned, above, FIG. 18 is a diagram similar to FIGS. 9 and 11 illustrating a converse case in which the underbody aircraft wing profiles have chords inclined to the waterline plane in a central zone and have chords lying in the waterline plane in zones spaced apart and located on opposite sides of the longitudinal vertical midplane of the hull.

The present invention is not exclusively limited to sailboats, i.e. sailing yachts and boats, since the desired flow conditions apply also to other boats, as for example to large tankers. With ships of such large dimensions it is desirable to achieve optimal planing at the lowest possible resistance. The constructive design according to the invention can also ,be realized in certain partial areas of such boats, always with regard to their length and width.

I claim:

1. A boat hull the underside of which, in longitudinal vertical planes in at least a central longitudinal zone of the portion of the hull lying below the waterline plane respectively has profiles which each are essentially the profile of the underside of an aircraft wing, each said profile having a downward vertex, the center of gravity of the boat being positioned in such a way that the stern of the boat in an unloaded quiescent condition thereof does not extend substantially below said waterline plane, the chord of each said aircraft wing profile in said vertical planes in said zone lying substantially in said waterline plane and a said downward vertex of each said profile being located, relative to the forward end of the said chord thereof, within a range of less than 40% of the entire chord length, wherein, in accordance to the invention, in said unloaded quiescent condition of the boat, each said aircraft wing profile (14) in a said vertical plane in said zone passes tangentially over into the chord at a spacing from the stern from 5 to 25% of the total length of the chord and is continued to the stern in the straight line of said chord, and at the bow, each said aircraft wing profile in a said vertical plane in said zone smoothly joins a rising bow profile in said vertical plane which intersects said waterline plane at an acute angle, the forward intersections of said profiles in said zone with said waterline plane which are respectively located in vertical planes at varying transverse spacings from the vertical longitudinal mid-plane (38) of the hull being disposed on one of two lines extending obliquely backwards, respectively on opposite sides of said longitudinal mid-plane, from the forward waterline plane intersection of the profile of said hull in said longitudinal mid-plane.

2. A hull according to claim 1, wherein the outer regions of the hull laterally beyond said central longitudinal zone also have an underside having, in each longitudinal vertical plane the profile of the underside of an aircraft wing smoothly meeting, near the bow end thereof, a rising bow profile and which, at least in part of each of said outer regions is continued to the stern in the straight line of the chord of said aircraft wing profile, the chords of said aircraft wing profiles in said outer regions being inclined relative to the chords of said aircraft wing profiles in said central longitudinal zone.

3. A hull according to claim 1, wherein said profile of said hull below said waterline plane in said vertical longitudinal mid-plane of the hull is continued forwardly above the waterline plane with nearly unchanged curvature at said waterline plane and forms the bow of the hull.

4. A hull according to claim 1, wherein said chord (S) of said profile (14) in the vertical longitudinal mid-plane (38) of the hull and also the chords (S) of said profiles, not only in said central longitudinal zone but also in portions of the hull extending laterally outwardly therefrom and lying in planes (54, 62, 30) parallel to said vertical longitudinal mid-plane (38), lie substantially in said waterline plane (12).

5. A hull according to claim 1, wherein said central longitudinal zone of the hull underside, in which the chord of said aircraft wing profile lies substantially in said waterline plane (12), is a narrow region close to said vertical longitudinal mid-plane and the portions of the underbody of said hull extending laterally from said central longitudinal zone have similar profiles in longitudinal vertical planes, of which profiles the chords (S) are parallel to said chords in said central longitudinal zone and lie at varying higher elevations which increase in height with increasing outward distance from the portion of said waterline plane occupied by said chords in said central longitudinal zone.

6. A hull according to claim 5, wherein said downward vertices (18, 58, 64) of said longitudinal profiles which are located at various spacings, from said vertical longitudinal mid-plane (38) of the hull on each side of said vertical longitudinal mid-plane lie on a line (51) extending obliquely backwards from the downward vertex of said profile in said longitudinal mid-plane.

7. A hull according to claim 5, wherein the stern has a transom (70) of two parts on opposite sides of said vertical longitudinal midplane, which meet in a line in said vertical longitudinal midplane and each form a second acute angle ($\phi_H$) with an athwartship plane passing through their junction line, where said two parts form with each other a dihedral angle of 180° less twice said second acute angle $\phi_H$.

8. A boat hull the underside of which, in longitudinal vertical planes, at least in two longitudinal zones of the portion of the hull lying below the waterline plane, spaced apart from each other and on opposite sides of the vertical longitudinal mid-plane (38) of the hull, has respective profiles which each are essentially the profile of the underside of an aircraft wing, each said profile having a downward vertex, the center of gravity of the boat being positioned in such a way that the stern of the boat in an unloaded quiescent condition thereof does not extend substantially below said waterline plane, the chord of each said aircraft wing profile in said zones lying substantially in said waterline plane and said downward vertex of each said profile being located relative to the forward end of the chord thereof, within a range of less than 40% of the entire chord length, wherein, in accordance with the invention, in said unloaded quiescent condition of the boat, each said aircraft wing profile (14) in a said vertical plane of said zone passes tangentially over into the chord at a spacing from the stern of from 5 to 25% of the total length of the chord and is continued to the stern in the straight line of said chord, and at the bow each said aircraft wing profile in a said vertical plane of a said zone smoothly joins a rising bow profile in said vertical plane which intersects said waterline plane at an acute angle, the forward intersections of said profiles with said waterline plane which are respectively located in vertical planes in said zones at varying transverse spacings from the longitudinal vertical mid-plane (38) of the hull being disposed on one of two lines extending obliquely backwards, respectively on opposite sides of said longitudinal mid-plane, from a single point which lies in said waterline plane and also in said longitudinal mid-plane.

9. A hull according to claim 8, wherein the central region of said hull between said two longitudinal zones also has an underside having in each longitudinal vertical plane in said central region the profile of the underside of an aircraft wing which, at least in part of said region, is continued to the stern in the straight line of the chord of said profile, the chords of said profiles in said central region being inclined relative to the chords of said profiles in said longitudinal zones.

* * * * *